US005223071A

United States Patent [19]

Gersbeck

[11] Patent Number: 5,223,071

[45] Date of Patent: Jun. 29, 1993

[54] APPARATUS FOR PRODUCING CHIP AND FIBERBOARD WEBS OF UNIFORM THICKNESS

[75] Inventor: Rolf Gersbeck, Ronnenberg, Fed. Rep. of Germany

[73] Assignee: Hermann Berstorff Maschinenbau GmbH, Hannover, Fed. Rep. of Germany

[21] Appl. No.: 729,023

[22] Filed: Jul. 12, 1991

Related U.S. Application Data

[62] Division of Ser. No. 466,753, Jan. 18, 1990, Pat. No. 5,057,167.

[30] Foreign Application Priority Data

Feb. 2, 1989 [DE] Fed. Rep. of Germany ..... 3903022

[51] Int. Cl.[5] ..... B30B 5/04; B30B 15/24; G05G 15/04

[52] U.S. Cl. ..... 156/358; 100/93 RP; 156/555; 156/583.5; 425/367; 425/373

[58] Field of Search ..... 156/358, 583.5, 555, 156/583.1, 62.2, 64; 100/47, 170, 93 RP, 158 R; 425/373, 367; 72/35

[56] References Cited

U.S. PATENT DOCUMENTS

| | | | |
|---|---|---|---|
| 3,006,225 | 10/1961 | Mamas | 425/367 |
| 3,358,485 | 12/1967 | DeCaro | 72/35 |
| 3,509,815 | 5/1970 | Lloyd | 100/47 |
| 3,874,962 | 4/1975 | Geisbeck | 425/373 |
| 3,902,114 | 8/1975 | Alich | 72/35 |
| 4,744,854 | 5/1988 | Schenz | 156/555 |
| 5,061,337 | 10/1991 | Fraser | 425/367 |

FOREIGN PATENT DOCUMENTS 1442909 7/1976 United Kingdom ..... 425/373

*Primary Examiner*—Michael W. Ball
*Assistant Examiner*—Daniel J. Stemmer
*Attorney, Agent, or Firm*—Foley & Lardner

[57] ABSTRACT

Apparatus for continuously manufacturing chip-and fiber-board webs having uniform thickness across their width in a press comprising a centrally disposed press cylinder journalled to rotate in bearings in uprights and at least one pressure roller disposed adjacent to periphery of the press cylinder. An endless steel band which carries the material for forming the web and which is subjected to tensile stress, is guided around the press cylinder and through the nip defined between the press cylinder and the pressure roller. The material is then pressed between the endless steel band and the surface of the press cylinder. The pressure roller is journalled for rotation in bearing bodies at each of its ends, with the bearing bodies being connected to piston and cylinder arrangements. When the press is in its loaded state, the bearing body at one end of the pressure roller is displaced by the application of a preselected pressure towards the axis of rotation of the press cylinder. The spacing between the external surface of the press cylinder and that of the pressure roller is measured at this end of the roller. On the basis of the distance measured at this end, the same spacing is set at the other end of the pressure roller by adjusting the bearing body at that end. By input to a microprocessor, it is possible to preselect specific gap sizes at the pressure rollers to produce a specific thickness of board, with the pressure rollers then being held exactly parallel.

1 Claim, 2 Drawing Sheets

APPARATUS FOR PRODUCING CHIP AND FIBERBOARD WEBS OF UNIFORM THICKNESS

This application is a division of application Ser. No. 07/466,753, filed Jan. 18, 1990 now U.S. Pat. No. 5,057,167.

FIELD OF THE INVENTION

The present invention relates to a method and apparatus for producing chip and fiberboard webs of uniform thickness. More particularly, the present invention relates to a method and apparatus for producing chip-and fiberboard webs in a continuous pressing operation.

BACKGROUND OF THE INVENTION AND PRIOR ART DISCUSSION

A continuously operating press for producing chip and fiberboard webs is disclosed in U.S. Pat. No. 3,874,966. Such a press comprises a central press cylinder which is journalled to rotate in upright support members. A plurality of guide and pressure rollers are disposed around the periphery of the press cylinder. An endless steel band is guided around the press cylinder, which band is subjected to tensile stress. The chips or fibers to be pressed into a web are mixed with a binder and are carried on the band. The web is formed by the effect of pressure on the chips or fibers. Such pressure emanates from two sources. Firstly, there is a surface pressure between the band and the periphery of the press cylinder, which latter is heated. Secondly, there is a nip pressure in the nips between each of the pressure rollers and the periphery of the press cylinder. Each end of each pressure roller is journalled to rotate in bearings. A continuous web, generally having a thickness of from 0.8 mm to 12 mm and a width of up to 2500 mm, is produced which is subsequently cut to desired lengths.

The pressing operation takes place between the periphery of the rotating, heated pressing cylinder and the endless steel band which is subjected to a high tensile stress. For this purpose, a spread chip cake or non-woven material is conveyed into the press by the steel band and is pressed, at an elevated temperature during the time in which the band is disposed adjacent the periphery of the press cylinder.

If the thickness of the web exceeds a certain value, a web continuously produced on a press of this type will exhibit a tendency to bend. However, this is relatively unimportant for many intended uses of the web. However, in order to widen the range of use of the chip and fiberboards produced in this manner, the tendency of the web to bend has been reduced using larger diameter press cylinders. Thus, press cylinders having a diameter of 5,000 mm have been used instead of the hitherto customary diameter of 3,000 mm. The radius of curvature is therefore larger and this reduces the tendency of the manufactured chip and fiberboard webs to bend.

On the other hand, press cylinders of this type have a weight of approximately 110 tons. The journalling of the cylinder and of the pressure roller is therefore a complex and expensive process.

A greater disadvantage resides, however, in the fact that it is extremely difficult to manufacture chip or fiberboard webs having only small permitted tolerances of thickness across the entire width of the web, bearing in mind the fact that the web is often 2,200 mm or 2,500 mm wide. Due to the heavy weight of the press cylinder and the play inevitably occurring in the bearings and between the bolted-together components of the uprights as a result of their assembly, it is extremely difficult to control accurately the thickness of the web.

A non-woven material having a thickness of, for example, 8 cm is located on a conveyer belt and is initially pre-compressed to a thickness of approximately 5 cm in a pre-press before being transferred into the main press in which it is to be compressed to a thickness of, for example, 3 mm. The first stage of the pressing operation takes place in the nip between the first pressure roller and the central press cylinder. A surface pressure of up to 20 $N/cm^2$ is built up on the pressed chip cake by the tensioned endless steel band. The chip cake is subjected to a further very high line pressure in the ensuing nip between the next pressure roller and the press cylinder.

A web pressed in this manner and having a thickness of 3 mm has a permitted thickness tolerance of only $\pm 0.2$ mm for it to be suitable for further processing. The attainment of this object is very difficult to achieve due to the weight of the central cylinder, often of the order of 110 tons and due to the air trapped in the bearings and between the bolted-together components of the uprights.

OBJECT OF THE INVENTION

The present invention seeks to provide a method and apparatus for manufacturing chip and fiberboard webs which have a uniform thickness across their width. The pressed board itself should have only small variations in thickness within permitted tolerances, even if the non-woven material which has been compressed at a ratio spread of approximately 27:1 has different spread thicknesses. As well understood, the term "ratio spread" refers to the thickness of the uncompressed material relative to the thickness of the compressed material.

SUMMARY OF THE INVENTION

According to the present invention, there is provided a method of continuously manufacturing chip and fiberboard webs having a substantially uniform thickness across their entire width in a press, the press comprising a centrally disposed, heated press cylinder journalled to rotate in upright support means, a plurality of guide rollers and pressure rollers disposed around the external surface of the press cylinder and an endless steel band subjected to tensile stress which is guided around the press cylinder, each pressure roller being journalled for rotation in bearing bodies disposed at each end of each said pressure roller, the method comprising the steps of mixing the chip or fiber layer with a binding agent and conveying said layer on said band whereby the layer is subjected to a surface pressure between the endless steel band and the press cylinder and to a line pressure in the nips between the press cylinder and the pressure rollers, wherein the bearing body provided at one end of a pressure roller is displaced, by the application of a preselected pressure, towards the bearing axis of the press cylinder when the press is in its loaded state, measuring the spacing between external surface of the press cylinder and the external surface of the pressure roller at said end of the pressure roller at said preselected pressure and, on the basis of the spacing measured at one end, setting an equal spacing between the external surface of the press cylinder and the external surface of the pressure roller at the second end of the pressure roller by displacing the bearing body associated with said second end.

Also according to the present invention, there is provided a press for continuously manufacturing chip and fiberboard webs having a substantially uniform thickness comprising a centrally disposed press cylinder journalled to rotate in bearings formed in upright support members, at least one pressure roller journalled to rotate in bearing bodies, the at least one roller being displaceable towards and away from the axis of the press cylinder and pressing, hydraulically or mechanically, in a direction towards the external surface of the press cylinder and an endless steel band subjected to tensile stress guided around the press cylinder wherein each bearing body for each pressure roller has a hydraulic piston and cylinder arrangement associated therewith for separately displacing the bearing body in directions towards and away from the axis of the press cylinder a travel sensor being provided for detecting the amount of displacement of the bearing body associated therewith the travel sensors being connected to a microprocessor which controls pressure valves for the hydraulic piston and cylinder arrangements in dependence upon the displacement detected.

A web having a uniform thickness with the required close tolerances is produced by the method and apparatus of the present invention. This is despite inevitable variations in the spread thickness of the chip cake or non-woven material since it is not possible to spread a chip cake or a non-woven material in such a way that it has an exactly uniform thickness.

The bearing body at one end of a pressure roller is moved towards the press cylinder by the application of a high pressure which ensures adequate pressing of the chip cake or non-woven material. Upon attaining a specific pressure force established by the pressure at which the hydraulic piston and cylinder arrangement displaces the bearing body, the spacing between the respective external surfaces of the pressure roller and the press cylinder is ascertained by a travel sensor.

On the basis of the spacing which is ascertained at one end of the gap, the spacing at the other end of the gap is set by means of the hydraulic piston and cylinder arrangement which acts upon the bearing body, with the aid of a travel sensor connected to a microprocessor. The microprocessor controls the valves for the piston and cylinder arrangements on the basis of the values monitored by the travel sensor. In this latter case, the hydraulic piston and cylinder arrangement is controlled not in dependence upon the pressure, but in accordance with the amount of travel, so that the exact desired position of the bearing at this end of the gap at the utilised pressure value can be determined.

BRIEF DESCRIPTION OF THE DRAWINGS

One embodiment of an apparatus in accordance with the present invention will be further described, by way of example, with reference to the accompanying drawings, in which.

DESCRIPTION OF PREFERRED EMBODIMENT

Figure 1:
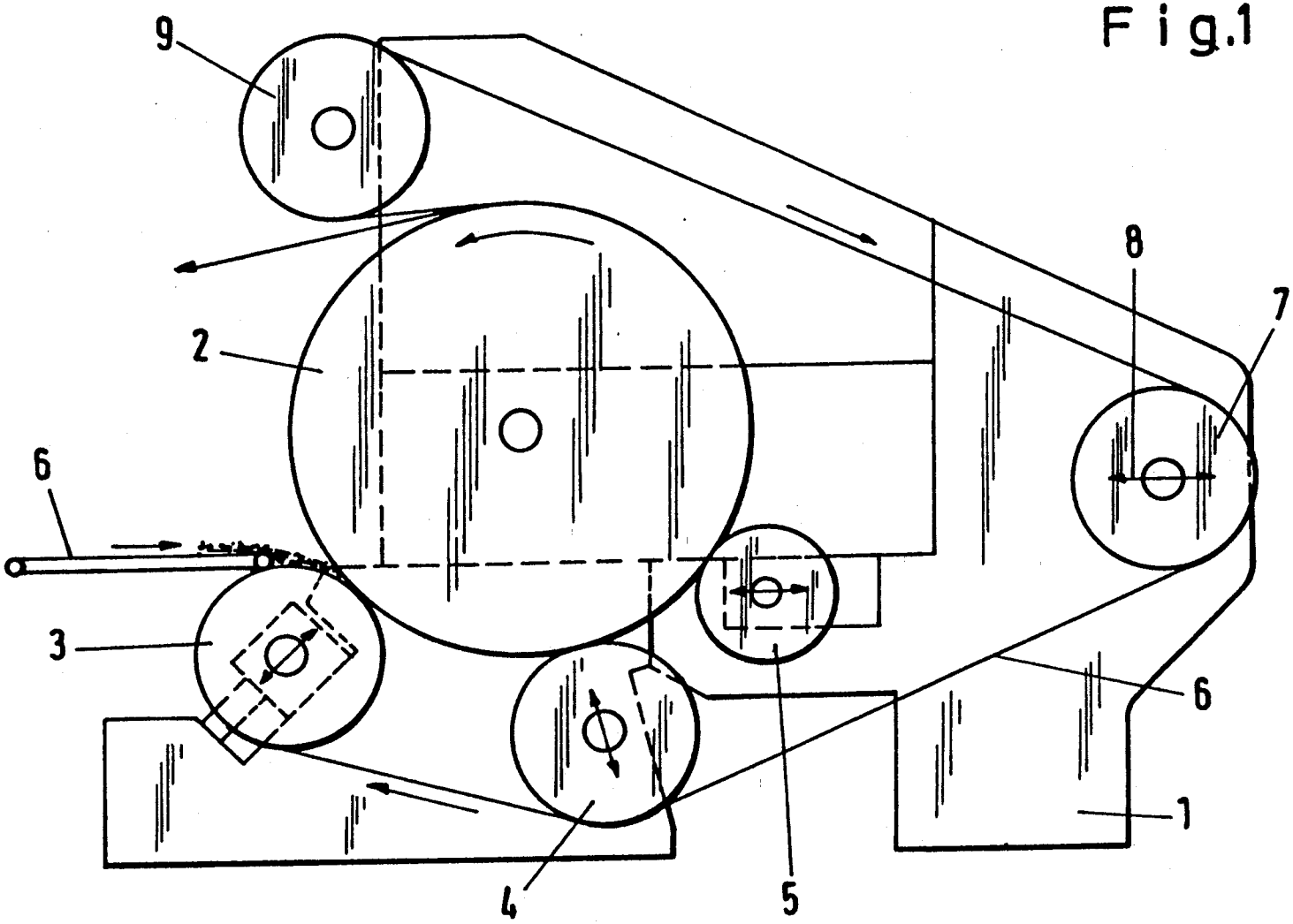
FIG. 1 is a schematic longitudinal sectional view through a rotary press in accordance with the present invention.

In FIG. 1, there is shown a rotary press which comprises an upright support member 1 on which a central press cylinder 2 is supported so as to be rotatable. Pressure rollers 3, 4 and 5 are associated with the press cylinder 2.

An endless steel band 6 is provided which is subjected to a high tensile stress by a tension roller 7 around which it passes. The roller 7 is adjustable in the directions of the double-headed arrow 8. The steel band passes around the press cylinder 2, a guide roller 9 and the pressure rollers 3 and 4 as well as the tension roller 7.

Figure 2:
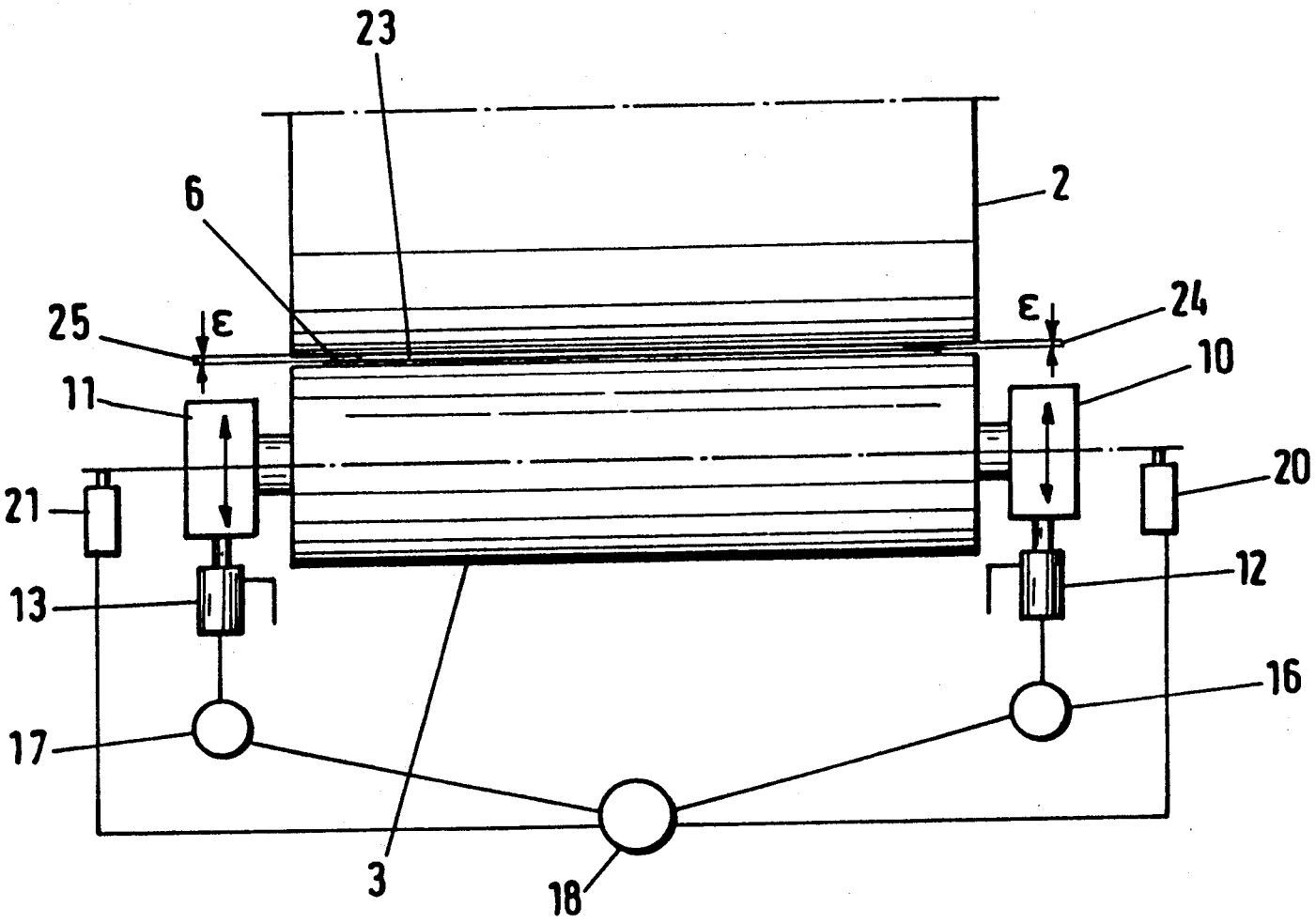
FIG. 2 is a cross sectional view of a pressure roller and a portion of a central press cylinder forming part of the press shown in FIG. 1.

The pressure rollers 3, 4 and 5 are each mounted so as to be adjustable in the directions of the double-headed arrows associated therewith by means of hydraulic piston and cylinder arrangements (not shown in FIG. 1). In the cross-sectional view shown in FIG. 2, however, it can be seen that adjustment devices are disposed at each end of the pressure roller 3; these being hydraulic piston and cylinder arrangements 12 and 13 which act upon the bearing bodies 10 and 11 respectively in which the roller 3 is journalled to rotate.

Each hydraulic piston and cylinder arrangement has a valve unit 16, 17 connected thereto, the valve units being connected to a microprocessor 18.

Travel sensors 20 and 21 are also connected to the microprocessor 18. These sensors 20 and 21 sense any movement of the center-line of the bearing bodies from their original positions.

The nip between the external surface of the press cylinder 2 and the external surface of the pressure roller 3 is designated 24 at one end of the roller 3 and 25 at the opposite end thereof. The reason for this will become apparent hereinafter.

A spread of non-woven material is introduced into the press by means of a conveyor belt 6*a* and is pressed to form a fiberboard having a thickness of, for example, 3 mm. To produce a fiberboard web of this thickness, a pressing gap of the appropriate thickness has to be set between the pressure rollers 3, 4 and 5 respectively, and the press cylinder 2. The thickness of the gap will be substantially 3 mm plus the thickness of the endless tensioning band 6 which is approximately 1.8 mm.

The pressing of the non-woven material 23 is caused by the surface pressure applied by the tensioned, endless steel band 6 which is guided around a major portion of the surface of central press cylinder 2. A high pressure is built up in the nips between the pressure rollers 3, 4 and 5 respectively, and the press cylinder 2.

The same distance 24 and 25 must be set at each end of the roller 3 in order to maintain uniform pressing gap of 3 mm thickness across the entire width of the roller. For this purpose, a pressure of, for example, 200 bars is first built up on the chip cake or non-woven material by appropriately controlling the valve unit 16 by means of the microprocessor 18. Such pressure effects a compression of approximately 5:1 (on the chip cake) or 17:1 (on the non-woven material) respectively. The distance travelled by the bearing body 10 is ascertained by the travel sensor 20 and is signalled to the microprocessor 18. When a gap 24 of 3 mm is achieved the hydraulic piston and cylinder arrangement 12 is deactivated by the microprocessor 18 transmitting an appropriate signal to the valve unit 16.

The valve unit 17 is then activated by the microprocessor 18, so that the hydraulic piston and cylinder arrangement 13 moves the bearing body 11 towards the press cylinder 2. The distance travelled is detected by the travel sensor 21 and a signal is transmitted to the microprocessor 18. When a gap thickness 25 of 3 mm is attained, the microprocessor 18 stops further movement of the piston of the piston and cylinder arrangement 13 by transmitting an appropriate signal to the valve unit 17. The gap or nip of 3 mm which has been set is thus maintained, irrespective of the pressure applied by the hydraulic piston and cylinder arrangement 13. This pressure can be entirely different from the pressure applied by the hydraulic piston and cylinder arrangement 12.

The spacings 24 and 25 can thus be maintained identical and constant at all times. This is despite the fact that the hydraulic piston and cylinder arrangements 12 and 13 may be applying different pressures and despite the fact that the spread thickness of the chip cake or non-woven material 23 may vary.

A device of the above-described type for adjusting and maintaining the nip between the rollers 3, 4 and 5 and the press cylinder 2 constant is disposed on each pressure roller 3, 4 and 5. The nips may all be set to be the same or different. In this latter case, the size of all of the gaps is controlled by a central microprocessor (not shown).

I claim:

1. A press for continuously manufacturing chip and fiber-board webs having a substantially uniform thickness, said press having a press cylinder with an external curved surface, journalling means rotatably mounting said press cylinder about an axis of rotation, and upright support means accommodating said journalling means, comprising:

a) at least one pressure roller disposed adjacent said external curved surface of said cylinder, said pressure roller having first and second end regions and an external curved surface, said respective external curved surfaces jointly defining a pressing nip;

b) bearing body means disposed at each of said first and second end regions and mounting said pressure roller for rotation;

c) an endless steel band disposed around said curved surface of said cylinder and passing through said pressing nip for carrying said chips or fibers, and means for tensioning said band;

d) a hydraulic piston and cylinder arrangement disposed at each of said first and second ends of said pressure roller, each said arrangement including a piston rod acting on said bearing body disposed at said respective end of said roller to cause displacement of said associated bearing body towards and away from said axis of rotation of said press cylinder;

e) separate valve means associated with each of said piston and cylinder arrangements for controlling actuation thereof;

f) microprocessor means selectively controlling the actuation of each said valve means; and g) travel sensor means mounted at said first and second ends of said pressure roller for detecting said displacement of said bearing bodies for said first and second ends of said pressure roller, said travel sensor means being operatively connected to said microprocessor, and wherein said microprocessor controls actuation of said valve means, in dependence upon the amount of displacement detected by said travel sensors, whereby the thickness of said pressing nip is ascertained at said first end of said pressure roller by the adjacent travel sensor means which transmits a signal to said microprocessor, the latter in turn actuating the valve means associated with said second end of said roller for displacing said associated bearing body, said displacement continuing until the thickness of said pressing nip at said second end is identical, as ascertained by the travel sensor means mounted at said second end of said pressure roller, to said thickness previously established at said first end of said pressure roller.

* * * * *